US011710405B2

(12) United States Patent
Moncomble

(10) Patent No.: US 11,710,405 B2
(45) Date of Patent: Jul. 25, 2023

(54) METHOD FOR DETERMINING A COMMUNICATIONS SCENARIO AND ASSOCIATED TERMINAL

(71) Applicant: ORANGE, Issy-les-Moulineaux (FR)

(72) Inventor: Ghislain Moncomble, Chatillon (FR)

(73) Assignee: ORANGE, Issy-les-Moulineaux (FR)

( * ) Notice: Subject to any disclaimer, the term of this patent is extended or adjusted under 35 U.S.C. 154(b) by 0 days.

(21) Appl. No.: 16/956,146

(22) PCT Filed: Dec. 7, 2018

(86) PCT No.: PCT/FR2018/053160
§ 371 (c)(1),
(2) Date: Jun. 19, 2020

(87) PCT Pub. No.: WO2019/122579
PCT Pub. Date: Jun. 27, 2019

(65) Prior Publication Data

US 2020/0342759 A1 Oct. 29, 2020

(30) Foreign Application Priority Data

Dec. 22, 2017 (FR) ..... 1763134

(51) Int. Cl.
*G08G 1/16* (2006.01)

(52) U.S. Cl.
CPC ..... *G08G 1/161* (2013.01); *G08G 1/166* (2013.01)

(58) Field of Classification Search
CPC ..... G08G 1/16
See application file for complete search history.

(56) References Cited

U.S. PATENT DOCUMENTS 6,417,784 B1 * 7/2002 Hilliard ..... G08G 1/015 340/906
2003/0102997 A1 * 6/2003 Levin ..... G01S 7/006 342/57

(Continued)

OTHER PUBLICATIONS

English translation of the Written Opinion of the International Searching Authority dated Mar. 22, 2019 for corresponding International Application No. PCT/FR2018/053160, filed Dec. 7, 2018.

(Continued)

*Primary Examiner* — Nabil H Syed
*Assistant Examiner* — Cal J Eustaquio
(74) *Attorney, Agent, or Firm* — David D. Brush; Westman, Champlin & Koehler, P.A.

(57) ABSTRACT

A method for determining a communications scenario corresponding to an action for producing, by a first movable element situated in a traffic lane, a response to an event. The method includes: determining an event in a vicinity of the first movable element, depending on at least one neighbouring element from a list of neighbouring elements positioned in the vicinity; determining a series of actions able to be performed in response to the event, by consulting a lookup table between at least one event and at least one series of actions; for at least one action of the series of actions, determining a communications scenario associated with the action, the determining a scenario including a sub-step of selecting, in the list of elements, for at least one communications scenario message, at least one neighbouring element receiving the message.

13 Claims, 4 Drawing Sheets

(56) References Cited

U.S. PATENT DOCUMENTS

| | | | | |
|---|---|---|---|---|
| 2005/0222756 | A1* | 10/2005 | Davis | G01C 21/3484 701/466 |
| 2013/0099911 | A1 | 4/2013 | Mudalige et al. | |
| 2013/0099941 | A1* | 4/2013 | Jana | G08G 1/093 340/905 |
| 2015/0161893 | A1 | 6/2015 | Duncan et al. | |
| 2015/0200835 | A1* | 7/2015 | Choi | H04L 65/1104 709/224 |
| 2017/0174261 | A1* | 6/2017 | Micks | B62D 15/029 |
| 2017/0291608 | A1 | 10/2017 | Engel et al. | |
| 2020/0137538 | A1* | 4/2020 | Chen | H04W 72/04 |

OTHER PUBLICATIONS

International Search Report dated Mar. 13, 2019 for corresponding International Application No. PCT/FR2018/053160, filed Dec. 7, 2018.

Written Opinion of the International Searching Authority dated Mar. 13, 2019 for corresponding International Application No. PCT/FR2018/053160, filed Dec. 7, 2018.

* cited by examiner

METHOD FOR DETERMINING A COMMUNICATIONS SCENARIO AND ASSOCIATED TERMINAL

CROSS-REFERENCE TO RELATED APPLICATIONS

This Application is a Section 371 National Stage Application of International Application No. PCT/FR2018/053160, filed Dec. 7, 2018, which is incorporated by reference in its entirety and published as WO 2019/122579 A1 on Jun. 27, 2019, not in English.

BACKGROUND OF THE INVENTION

The present invention relates to the field of autonomous vehicles and assistance for the driving of a vehicle or for the traveling of a living being, and more particularly concerns a technique for determining a communications scenario corresponding to an action that can be performed by a mobile element, such as a vehicle or a living being.

In a known manner, certain motor vehicles are equipped with systems used to assist the drivers of these vehicles when they are driving these vehicles, or to replace the drivers.

A vehicle equipped with such a system is able to determine an event on the circulation route, for example by analyzing images obtained by a camera positioned on the vehicle, and to determine and perform an action in response to the detected element.

The determination of the action to be performed is thus carried out at the level of the vehicle, on the basis of data obtained by means specific to the vehicle, including indicators on the circulation route, as well as indicators of the presence and where applicable the behavior of other vehicles present on the circulation route.

Furthermore, the vehicle can where applicable transmit items of information to another vehicle located nearby.

In order to determine the identifier of this other vehicle making it possible to send a message comprising these items of information, the vehicle analyzes an image obtained by the camera in order to determine the registration plate number of this other vehicle, then sends the registration plate number to a remote server. The remote server can then consult a database by means of the registration plate number, in order to determine the identifier of the other vehicle.

However, it is not always possible for the vehicle to determine the registration plate number, for example when weather conditions are poor, when the ambient brightness is low or when the distance between the two vehicles is great. The other vehicle may furthermore not be visible from the vehicle, for example because it is hidden by an element of the environment such as an obstacle, a hedge or a wall.

Furthermore, this determination technique is not easy to implement in countries in which registration plates are not standardized, such as the United States of America, where character fonts vary according to the State and where the front and rear plates can be different and include personalized inscriptions.

The vehicle can furthermore send geolocated items of information to a remote server which then stores these items of information. Other vehicles can then consult the server in order to retrieve the items of information. This indirect communication technique is for example useful for signaling an obstacle.

However, this indirect communication technique consumes a good deal of energy and congests the concerned telecommunications networks, since all vehicles must consult the remote server periodically, without knowing whether or not this is necessary.

The response time of the remote server is thus quite important, which entails that this indirect communication technique is not suitable for situations requiring a rapid reaction and a reaction not concerning all the vehicles circulating on the concerned route (for example a situation in which a vehicle overtakes another vehicle or a situation in which two vehicles arrive at an intersection), which thus poses a problem of vehicle user safety.

SUBJECT AND SUMMARY OF THE INVENTION

The present invention concerns a method for determining a communications scenario corresponding to at least one action that can be performed by a first mobile element located on a circulation route, in response to at least one event, implemented by a first terminal associated with the first mobile element, characterized in that it comprises the following steps:

determining at least one event in a neighborhood of the first mobile element, as a function of at least one neighboring element of a list of neighboring elements positioned in said neighborhood, said list of neighboring elements comprising at least one neighboring element, determining at least one series of actions, which can be performed in response to said at least one event, by consulting a table of correspondence between at least one event and at least one series of actions, said determined series of actions comprising at least one action, for at least one action of said at least one series of actions, determining a communications scenario associated with said at least one action, said scenario comprising at least one message, the step of determining a communications scenario comprising a sub-step of selecting, from said list, for at least one message of the communications scenario, at least one recipient neighboring element of said message.

Thus, the first mobile element can warn in a direct and certain manner the neighboring elements concerned by the action that should be performed in response to the event, the neighboring elements concerned by the action being the elements on which the action could have an impact if it was performed, or those which due to their response could prevent the triggering of said action.

This direct communication makes it possible to conserve network resources and to rapidly warn the neighboring elements concerned by the action that can be performed. The comfort and safety of the users are thus improved.

In a particular embodiment, the determining step comprises, for said at least one action of said at least one series of actions, determining an instant at which the performing of the action starts and a time period taken to perform the action, such that said at least one recipient neighboring element of said message is selected as a function of said instant at which the performing of the action starts and of said time period taken to perform the action.

In a particular embodiment, the table of correspondence comprises at least two events, each event being associated with a series of actions that can be performed.

In a particular embodiment, the step of determining a communications scenario comprises the obtaining of an MSISDN number of a terminal associated with said at least one recipient neighboring element of said message.

In a particular embodiment, at least one neighboring element of said list of neighboring elements is determined as a function of:

a geolocation position, and/or
a speed, and/or
a direction of traveling, and/or
a sense of traveling, of the first mobile element and the neighboring element, at a first instant corresponding to the implementation of the determination of the list of neighboring elements, and to at least a second instant corresponding to the first instant to which is added a provisional time period taken to perform one or more actions of the series of actions.

In a particular embodiment, the step of determining said at least one event comprises a sub-step of confirming the geolocation position of the at least one neighboring element of the list of neighboring elements, by means of a measurement made by the first terminal.

The confirming sub-step can allow the updating of the geolocation position of the at least one neighboring element, which allows a more precise determination of the event and thus improves the safety of the users.

In a particular embodiment, an item of content of the at least one message of the scenario is normalized and comprises at least one item of information from among the following list of items of information:

the scenario,
the action corresponding to the message,
an item of context-related data of the first mobile element depending on said at least one action corresponding to the message,
a number of the message in the scenario,
an identifier of the first terminal,
a time indicator concerning said at least one action corresponding to the message,
a time indicator concerning at least one other action of the series of actions SAC,
an indicator concerning the follow-up to be given to the message,
a list of possible responses comprising at least one response.

The invention also concerns a method for communicating comprising the method for determining described above, comprising a step of sending, by the first terminal and via a telecommunications network, the at least one message of the scenario to the recipient neighboring element.

In a particular embodiment, the sending is carried out according to a Rich Communication Service (RCS) protocol, and said at least one message is a Session Initiation Protocol (SIP)-option message.

The invention further concerns a terminal able to implement a method for determining as described above.

In a particular embodiment, the different steps of the method for determining and/or the method for communicating according to the invention are determined by computer program instructions.

Consequently, another aim of the invention is a computer program, on a data medium, this program including instructions suitable for implementing the steps of a method for determining and/or a method for communicating according to the invention.

This program can use any programming language, and be in the form of source code, object code, or intermediate code between source code and object code, such as in a partially compiled form, or in any other desirable form.

Another aim of the invention is a data medium readable by a computer and including the instructions of a computer program as mentioned above.

The data medium can be any entity or device capable of storing the program. For example, the medium can include a storage means, such as a ROM, for example a CD ROM or a microelectronic circuit ROM, or else a magnetic storage means, for example a hard disk.

Moreover, the data medium can be a transmissible medium such as an electrical or optical signal, which can be conveyed via an electrical or optical cable, by radio or by other means. The program according to the invention can be in particular be downloaded over a network of Internet type.

Alternatively, the data medium can be an integrated circuit into which the program is incorporated, the circuit being suitable for executing or being used in the execution of the method in question.

BRIEF DESCRIPTION OF THE DRAWINGS

Other features and advantages of the present invention will become apparent from the description given below, with reference to the appended drawings which illustrate an exemplary embodiment thereof, devoid of any limiting nature. In the figures.

DETAILED DESCRIPTION OF SEVERAL EMBODIMENTS

Figure 1:
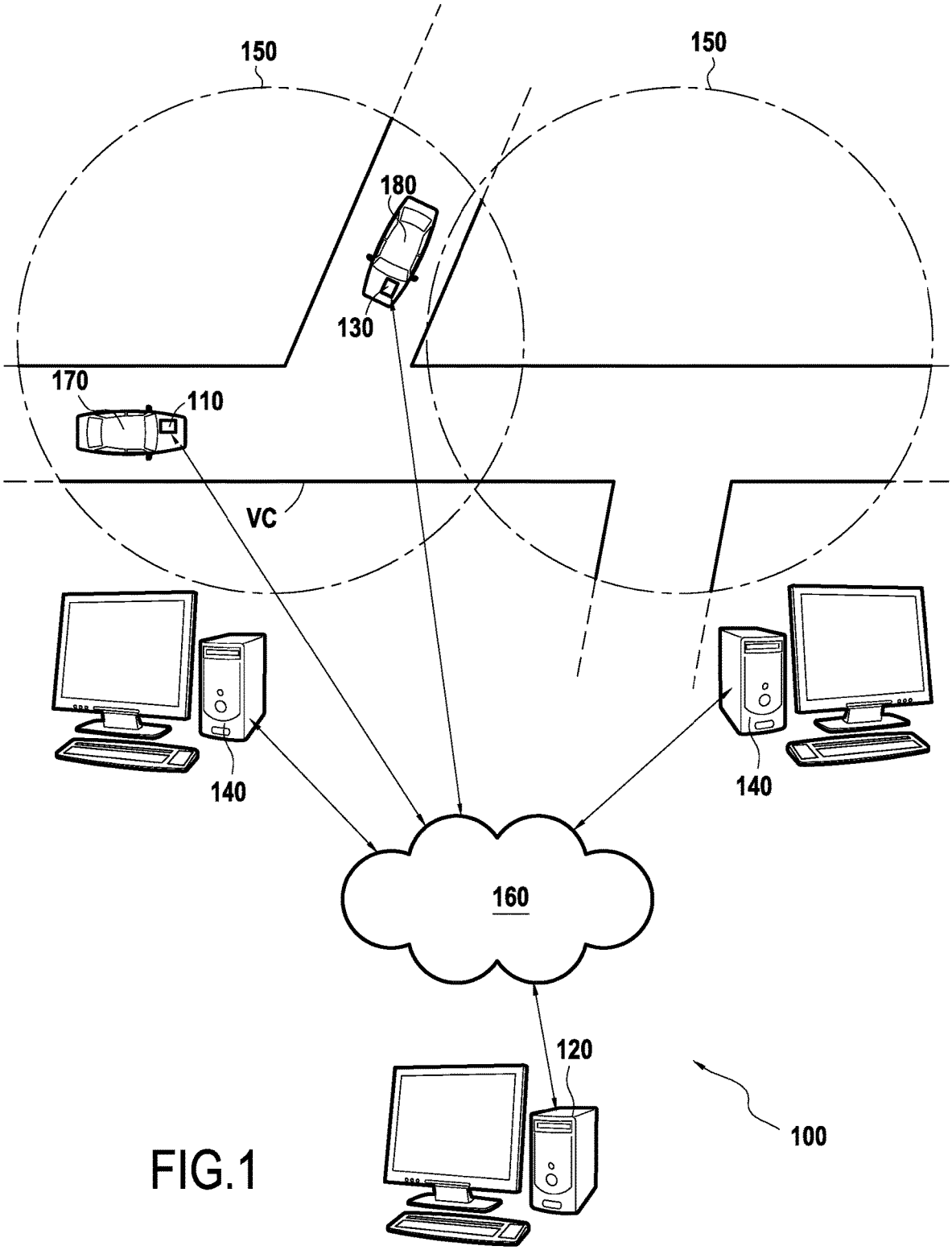
FIG. 1 shows, schematically, a system able to implement a method for determining a communications scenario according to an exemplary embodiment of the invention.

FIG. 1 shows, schematically, a system 100 able to implement a method for determining a communications scenario according to an exemplary embodiment of the invention.

The system 100 comprises a first terminal 110 and a main remote server 120. The system can further comprise a second terminal 130.

The system can also comprise several secondary remote servers 140, each secondary remote server 140 being associated with a predetermined geographical area 150.

The geographical area 150 corresponds in an example to a predetermined portion of circulation route VC, or to a geographical surface area of several kilometers in diameter, typically 20 kilometers. As can be seen in FIG. 1, two adjacent geographical areas 150 can overlap.

The first terminal 110, the main remote server 120 and where applicable the second terminal 130 and/or the secondary remote servers 140 can be connected to a telecommunications network 160 in order to communicate between each other. No limitation is attached to the nature of the telecommunications network. This may for example be an Internet network (for example WiFi), or a mobile telephone network (of 3G, 4G etc. type).

The first terminal 110 can be a mobile terminal such as a mobile phone, for example of "smartphone" type, a digital tablet, or a personal computer.

The first terminal 110 is associated with a first mobile element 170, the first mobile element 170 being typically a vehicle or a living being.

The first mobile element 170 is for example located on a circulation route VC. The first mobile element 170 circulates for example on the circulation route or beside it (typically when the first mobile element is a living being).

The first terminal 110 can thus be positioned on a first vehicle 170, typically inside the first vehicle 170, or incorporated into the first vehicle 170.

In a variant, the first terminal 110 can be carried by a living being, such as a human being or an animal, typically a dog.

The second terminal 130 can be a mobile terminal such as a mobile phone, for example of "smartphone" type, a digital tablet, or a personal computer.

Furthermore, the second terminal 130 is associated with a second element 180, this second element 180 being typically a mobile element such as a vehicle or a living being or a fixed element, such as a display panel.

The second element 180 is for example located on a circulation route VC. When the second element 180 is mobile, it circulates for example on the circulation route or beside it (typically when the first mobile element is a living being). When the second element 180 is fixed, it can be positioned on the circulation route VC, typically beside or above it.

The second terminal 130 can thus be positioned at the level of a second vehicle 180, typically inside the second vehicle 180, or incorporated into the second vehicle 180.

In a variant, the second terminal 130 can be carried by a living being, such as a human being or an animal, typically a dog.

The first vehicle 170 and/or the second vehicle 180 can be an autonomous vehicle, and can take the form of a motorized vehicle such as a motor vehicle, a truck, a bus or a two-wheeler, a bicycle, a train, a tram or else a boat.

The system 100 can further include one or more other terminals, each terminal being associated with a mobile element such as a vehicle or a living being, or a fixed element, such as a display panel positioned on the circulation route VC.

In addition, the system 100 can include one or more other remote servers, for example dedicated to long-term storage.

Figure 2:
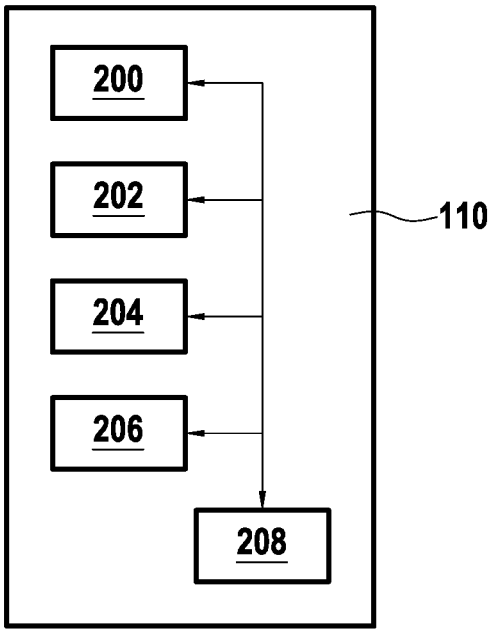
FIG. 2 shows, schematically, a first terminal of the system of FIG. 1.

As shown in FIG. 2, the first terminal 110 has the conventional architecture of a computer. The first terminal 110 particularly includes a processor 200, a read-only memory 202 (of ROM type), a rewritable non-volatile memory 204 (of EEPROM or NAND Flash type for example), a rewritable volatile memory 206 (of RAM type), and a communication interface 208.

The read-only memory 202 of the first terminal 110 constitutes a recording medium in accordance with an exemplary embodiment of the invention, readable by the processor 200 and on which is stored a computer program P1 in accordance with an exemplary embodiment of the invention. In a variant, the computer program P1 is stored in the rewritable non-volatile memory 204.

The computer program can allow the first terminal 110 to implement the method for notifying or communicating in accordance with an exemplary embodiment of the invention.

Furthermore, the first terminal 110 can comprise an onboard camera, a radar, a microphone, a laser scanner and/or a means of GPS or Galileo guidance.

In a variant the first mobile element 170 can comprise an onboard camera, a radar, a microphone and/or a means of GPS or Galileo guidance, which the first terminal 110 can access.

The onboard camera is then positioned on the windshield and/or the rear window of the first mobile element 170.

The main remote server 120, the second terminal 130 and/or each secondary remote server 140 can also have the conventional architecture of a computer, and can then each notably include a processor, a read-only memory (of ROM type), a rewritable non-volatile memory (of EEPROM or NAND Flash type for example), a rewritable volatile memory (of RAM type) and a communication interface.

Each read-only memory can constitute a recording medium in accordance with an exemplary embodiment of the invention, readable by the associated processor and on which is recorded a computer program in accordance with an exemplary embodiment of the invention. In a variant, the computer program is stored in the associated rewritable non-volatile memory. The computer program can allow the implementation of at least a part of the method for notifying or communicating in accordance with an exemplary embodiment of the invention.

Figure 3:
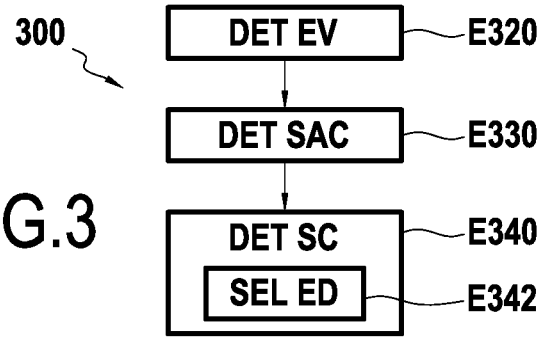
FIGS. 3 and 4 show, in the form of a flow chart, the main steps of the methods for determining a communications scenario, according to exemplary embodiments of the invention.

FIG. 3 shows a method 300 for determining a communications scenario corresponding to at least one action that can be performed by a first mobile element 170 located on a circulation route VC, in response to at least one event.

The method can be implemented by a first terminal associated with the first mobile element 170, such as the first terminal 110 described with reference to FIGS. 1 and 2.

In a step E320, at least one event EV in a neighborhood of the first mobile element 170 is determined, as a function of at least one neighboring element of a list of neighboring elements positioned in this neighborhood, the list of neighboring elements comprising at least one neighboring element.

In a step E330, at least one series of actions SAC which can be performed in response to said at least one event EV is determined, by consulting a table of correspondence between at least one event and at least one series of actions, the determined series of actions SAC comprising at least one action.

In a step E340, for at least one action of said at least one series of actions SAC, a communications scenario SC associated with said at least one action is determined, the scenario comprising at least one message.

The step E340 of determining a communications scenario SC comprises a sub-step E342 of selecting, from the list, for at least one message of the communications scenario, at least one recipient neighboring element ED of said message.

Figure 4:
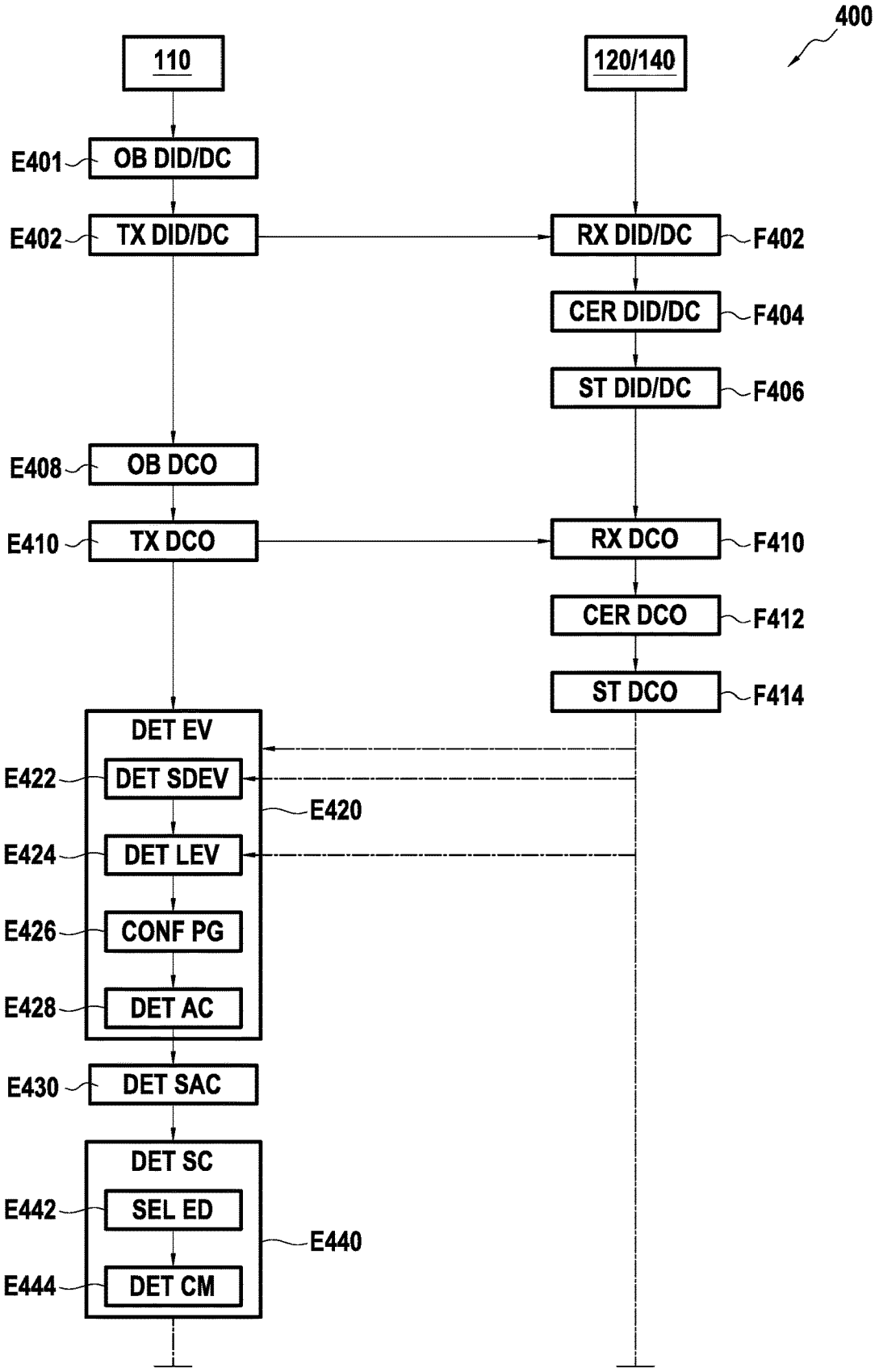

FIG. 4 shows a method 400 for determining a communications scenario corresponding to at least one action that can be performed by a first mobile element 170 located on a circulation route VC, in response to an event, according to another exemplary embodiment of the invention.

The method is implemented by a system such as the system 100 of FIG. 1.

In a step E401, the first terminal 110 obtains an item of identification data DID or characterization data DC of the first mobile element 170.

The item of identification data that can be obtained is typically the MSISDN (Mobile Station Integrated Services Digital Network) number of the first terminal 110 associated with the first mobile element 170. In a variant, the item of identification data can be the registration plate number of the first mobile element 170.

Furthermore, the item of characterization data that can be obtained can indicate the general category to which the first element 170 belongs, i.e. indicate if the first element 170 is fixed or mobile, or more precisely if the first element 170 is a motor vehicle, a truck, a bus, a two-wheeler, a bicycle, a train, a tram, a boat, a human being, an animal, or a display panel.

In a variant, the item of characterization data that can be obtained can indicate a sub-category of the general category to which the first element 170 belongs. For example, if the first element 170 is a vehicle, this item of data concerns the type of vehicle, the brand of the vehicle, the model of the vehicle, or the color of the vehicle.

In a variant, the item of characterization data that can be obtained indicates the weight of the first mobile element 170, the maximum speed of the first mobile element 170, the action capabilities of the first mobile element 170, the degree of autonomy of the first mobile element 170, an equipment link between the first terminal 110 and the first mobile element 170, or again the right of way of the first mobile element 170, typically in a country and/or with respect to a given event.

In a variant, the item of characterization data that can be obtained can concern the communication capabilities of the first element 170.

The "action capabilities" for example denote the capability of changing direction, or the capability of accelerating or decelerating. For example, a train or a tram does not have the capability of overtaking an element positioned on its circulation route, or does not have the capability of leaving the tracks of its circulation route.

The action capability can be a function of various parameters, such as the speed and/or the weight of the mobile element, the length, width and/or curvature of the circulation route available for carrying out the action, and where applicable the speed and/or the weight of other mobile elements circulating on the same circulation route.

In addition, the "autonomy" here denotes the capability of the mobile element of following and/or respond to a suggestion concerning the action to be carried out in response to an event. For example, an entirely autonomous vehicle can automatically take into account the suggestion and thus perform the suggested action, a vehicle possessing driving assistance can require an acknowledgement from the driver in order for the element that issued the suggestion to know that this suggestion is taken into account, and a vehicle not possessing driving assistance does not respond to the suggestions. Furthermore, an animal such as a dog does not respond to the suggestions and cannot perform the suggested action.

The "right of way" indicates if the mobile element has right of way during the management of a given event. The right of way can depend on the country in which the event occurs. An example concerns public service vehicles with right of way, typically ambulances, which have right of way in France during their interventions.

The "communication capabilities" denote for example the capability of the element of sending a message via the telecommunications network 160 or of displaying the message.

A display module such as a screen can specifically be positioned at the rear of a truck such as to be visible by other elements positioned at the rear of the truck. Similarly, a display panel can include a display module such as a screen. Such display modules can thus transmit messages to other elements, which is particularly useful when these elements are not able to receive the message via the telecommunications network 160 and/or to analyze it.

In a step E402, the first terminal 110 sends to the main remote server 120, via the telecommunications network 160, the item of identification data DID or characterization data DC obtained in step E401.

In an example, the first terminal 110 implements the step E402 when the first terminal 110 is registered with an application implementing the method or when the first mobile element 170 is registered.

In another example, the first terminal 110 implements the step E402 when the first terminal 110 is equipped with the first mobile element 170, or at the beginning of a journey on the circulation route VC.

The first terminal 110 can then keep all or part of the data, and send them to the main remote server 120 after being authenticated by the main remote server 120, which makes it possible to preserve the anonymity of the data when the method is not implemented. In a variant, in order to avoid an excessively high volume of data transfer, the first terminal 110 can send a link to a storage space of another remote server, typically after authentication of the first terminal 110 by the main remote server 120 and where applicable by the other remote server.

Step E401 and where applicable step E402 can be repeated one or more times by the first terminal 110 in order to obtain and send one or more additional items of identification data DID and/or characterization data DC of the first mobile element 170 (several items of data can be sent at the same time in step E402).

Steps E401 and E402 can also be repeated in order to update one or more items of data.

Specifically, certain items of data such as the weight of the first element, the equipment link or the right of way of the first element 170 can vary over time.

For example, the weight of a vehicle varies as a function of the loading of this vehicle. Furthermore, a vehicle can have right of way during an intervention and not have right of way outside these interventions. In addition, the equipment link between the first terminal 110 and the first element 170 can be effective during the traveling of the first element 170 and be cancelled when the first element 170 is not traveling.

Steps E401 and E402 can furthermore be implemented one or more times by one or more terminals associated with elements relating to the circulation route VC other than the first mobile element 170. The items of data obtained then relate to the element associated with the terminal implementing these steps.

Steps E401 and E402 can thus be implemented one or more times by the second terminal 130 associated with the second mobile element 180.

After receiving an item of data (step F402), the main remote server 120 records the item of data in order to store it (step F406), typically in a secure manner, where applicable after certifying it (step F404).

The item of data received in this step F402 can be stable, i.e. not vary over time. The storage time of the item of data can thus be considerable.

The items of identification data DID or characterization data DC concerning one and the same element are stored associated together by the main remote server 120. In an example, each item of data sent in step E402 by one and the same terminal associated with an element is accompanied by one and the same item of identification data, the item of identification data allowing the main remote server 120 to make the link between the items of data concerning one and the same element.

The main remote server 120 can furthermore receive, certify and/or store environmental data, such as:

- items of data relating to weather conditions of one or more geolocated areas 150 crossed by the circulation route VC (typically the temperature and rainfall which affect braking distances), and/or
- provisional or observed traffic data on the circulation route VC, and/or
- items of technical and/or statistical data on geolocated portions of the circulation route VC (the type of route, predefined circulation rules, traffic statistics etc.).

The type of route is for example a route including several sub-routes on which the elements circulate in the same sense, one route including two sub-routes on which the elements circulate in the opposite sense, one route opening onto an intersection with another route, a car park, a parking place etc.

The predefined circulation rules comprise the usual rules of the highway code and/or predefined rules relating to the route VC on which the first mobile element 170 is circulating (for example the speed limit).

In addition, the main remote server 120 can receive, certify and/or store one or more items of data concerning a particular use of a mobile element, typically of the first mobile element 170 and/or of the second mobile element.

The "particular use of the mobile element" denotes for example the behavior of the element with respect to the highway code (observed habits of speed, safety distance etc.), or the behavior of the element with respect to a behavior suggestion (for example if the mobile element has the habit of slowing down when it receives a braking suggestion). The items of data concerning the particular use of the mobile element are thus useful for evaluating safety distances.

The "particular use of the mobile element" can also denote one or more usual journeys of the mobile element, typically the journey going from the place of residence to the workplace of the element or of the user. This type of item of data can make it possible to automatically recognize a journey in progress made subsequently, even for a mobile element not comprising a terminal according to the invention.

Each usual journey can be determined as a function of journey histories, which can be provided by telecommunications operators.

In a step E408, the first terminal 110 obtains an item of context-related data DCO of the first mobile element 170.

The item of context-related data DCO obtained can be:

- a geolocation position of the first mobile element 170,
- a provisional trajectory of the first mobile element 170,
- a provisional journey of the first mobile element 170, the journey comprising a series of provisional trajectories,
- the speed of the first mobile element 170,
- a change in speed of the first mobile element 170,
- an item of data concerning the level of attention of the user of the first mobile element 170 or of the first mobile element 170 itself when the element is a living being, this item of data being determined by detecting whether or not the user or the element is carrying out an action, such as talking, listening to music or reading a message).

The first terminal 110 can obtain the geolocation position, the trajectory and/or the journey by accessing the GPS or Galileo guidance means of the first terminal 110 or of the first mobile element 170.

Furthermore, the first terminal 110 can obtain the speed and/or the change of speed as a function of the successive GPS coordinates of the first mobile element 170, obtained by accessing the GPS or Galileo guidance means of the first terminal 110 or of the first mobile element 170. The first terminal 110 can also obtain the speed and/or the change in speed by accessing the speed data of the speedometer of the first mobile element 170.

In addition, the first terminal 110 can obtain the item of data concerning the level of attention by accessing the microphone of the first terminal 110 or of the first mobile element 170 and by analyzing the items of data coming from the microphone, or by determining whether or not a call is in progress.

The first terminal 110 can furthermore obtain the item of data concerning the level of attention by accessing a sensor positioned on the seat of the user, or a camera able to obtain images of the user (the terminal being then able to detect a decrease in attention of the user by monitoring the changes in the face of the user, in particular at the eyeball).

In a step E410, the first terminal 110 sends to the main remote server 120, via the telecommunications network 160, the item of context-related data DCO, along with an item of identification data DID of the first mobile element 170.

The sending can be performed in real time, after obtaining the item of context-related data DCO performed in step E408.

After receiving the item of context-related data DCO (step F410), the main remote server 120 or the secondary remote server or servers 140 record the item in order to store it (step F414), typically in a secure manner, where applicable after certifying it (step F412).

More precisely, the item of context-related data DCO is stored in association with the item or items of identification data DID and/or characterization data DC concerning the first mobile element 170. The item of identification data DID of the first mobile element 170 sent in step E410 allows the main remote server 260 to make the link between the item of context-related data DCO received and the item or items of identification data DID and/or characterization data concerning the first mobile element 170, previously recorded by the main remote server 120.

In a variant, the item of context-related data DCO and also the item of identification data DID of the first mobile element 170 are sent to the secondary remote server 140 corresponding to the geographical area 150 in which the first mobile element 170 is positioned.

The secondary remote server 140 then stores the item of context-related data DCO in association with the item of identification data DID (step F414), typically in a secure manner, where applicable after certifying the item of context-related data DCO (step F412).

The secondary remote server 140 can then consult the main remote server 120 by sending the item of identification data DID in order to retrieve, then store in association with the item of context-related data DCO, one or more items of identification data DID and/or characterization data DC concerning the first mobile element 170.

The storage time of the data can be limited, typically to a few minutes after the first mobile element 170 has left the first geographical area 150. Thus, the secondary remote server 140 associated with the geographical area in which the first mobile element 170 is positioned can store, at a given instant, the geolocation position of the element at the given instant, one or more geolocation positions of the element at one or more instants preceding the given instant, and provisional trajectories at one or more instants following the given instant.

In a variant, the time of storage of the item of data can be longer than a few minutes, such that the secondary remote server 140 can supply this item of data for legal requirements (in order, for example, to determine liability in the event of an accident), or else so that the secondary remote server 140 can supply a journey history, for example to the main remote server 120, so that the main remote server 120 can determine an item of particular use data of the element, or provisional items of traffic data.

The item of context-related data can also be sent to a remote server dedicated to long-term storage, so that this item of data can be used for the abovementioned purposes.

When the first mobile element 170 is located in an area of overlap of two adjacent areas 150, the first mobile element 170 sends the item of context-related data to the two secondary remote servers 140 corresponding to the two adjacent areas 150.

The sharing of the geographical areas 150 between several secondary remote servers 140 makes it possible to reduce the data processing time at each server.

In addition, when the provisional journey of the first mobile element 170 is known, the secondary remote server 140 corresponding to the geographic area 150 in which the first mobile element 170 is positioned can send the item of context-related data to the secondary remote server 140 corresponding to the next geographic area 150 through which the provisional journey passes, such as to limit the interrogation time of this last secondary remote server 140 during the passage from one area to another.

Step E408 and where applicable step E410 can be repeated one or more times by the first terminal 110 in order to obtain and send one or more additional items of context-related data of the first mobile element 170 (several items of context-related data can be sent at the same time in step E410).

Steps E408 and E410 can furthermore be implemented one or more times by one or more terminals associated with elements relating to the circulation route VC other than the first mobile element 170. The items of data obtained then relate to the element associated with the terminal implementing these steps.

Steps E408 and E410 can thus be implemented one or more times by the second terminal 130 associated with the second mobile element 180.

The repetition of steps E408 and E410 can be carried out when the provisional trajectory, the provisional journey, the speed, the change in speed and/or the level of attention are modified.

The repetition of steps E408 and E410 can be periodic. The repetition period can be in the order of the second, which allows the updating in almost real time of the context-related data concerning the first mobile element 170.

The period of repetition can be longer so as not to saturate the telecommunications network 160, for example when the first mobile element 170 is making a provisional journey at a steady speed.

The repetition period can furthermore be adapted as a function of the observed density of traffic, the speed of the first mobile element 170, or as a function of the level of attention of the user of the first mobile element 170.

In a step E420, an event EV in a neighborhood of the first mobile element 170 is positioned and determined.

The step E420 can be implemented at the same time as steps E408 and E410, for example when the detected event EV corresponds to the start of a journey of the first mobile element 170. Furthermore, the step E420 can be implemented by the first terminal 110.

As described in more detail below, the neighborhood of the first element can correspond to a geographical area of a neighborhood around the first mobile element 170. The event can thus occur on the circulation route VC of the first mobile element 170, or else on another circulation route located near the circulation route of the first mobile element 170, for example crossing the circulation route VC of the first mobile element 170 at an intersection.

The step E420 can comprise a sub-step E422 of determining a series of items of data SDEV corresponding to the event EV, the series of items of data comprising at least one item of data, typically several items of data.

Each item of data of the series of items of data SDEV can be:

- an item of characterization data DC of the first mobile element 170 as obtained in step E401,
- an item of context-related data DCO of the first mobile element 170 as obtained in step E408, and/or
- an item of environmental data as received in step F402.

In an example, the series of items of data SDEV comprises:

- a type of circulation route VC on which the first mobile element 170 is positioned,
- a modification of the type of circulation route (typically the presence of an intersection nearby between the circulation route VC and another circulation route),
- the provisional trajectory of the first mobile element 170, and/or
- at least one predefined circulation rule.

Each item of data can be obtained by the first terminal 110 by consulting the main remote server 120 or the secondary remote server 140 associated with the geographical area 150 in which the first mobile element 170 is positioned, or be detected by the first terminal 110.

In addition, the step E420 can comprise a sub-step E424 in which a first list of neighboring elements positioned in a neighborhood of the first mobile element 170 is determined, said first list of elements comprising at least one mobile or fixed neighboring element. For each neighboring element of the first list, this first list comprises in an example an item of identification data and/or the geolocation position of this neighboring element.

Each neighboring element of the first list can be determined as a function of items of context-related data DCO of the first mobile element 170 and/or of said neighboring element, at a first instant corresponding to the implementation of sub-step E424 of determining the first list of neighboring elements, for example:

- a geolocation position, and/or
- a speed,
- a direction of traveling,
- a sense of traveling.

At least one element of the first list can furthermore be determined on the basis of a message concerning the behavior of said neighboring element (acceleration or deceleration, change of direction etc.) or else a detection of such a behavior.

A geographical area of a neighborhood around the first mobile element 170 can be determined, each element positioned in the geographical area being first added to the first list.

The surface area of the geographical area around the first mobile element 170 depends on the geolocation position of the first mobile element 170.

The surface area of the geographical area around the first mobile element 170 can furthermore depend on the speed of the first mobile element 170. More precisely, the higher the speed of the first mobile element 170, the greater the surface area.

In addition, the geographical area around the first mobile element 170 can depend on the sense of circulation of the first mobile element 170. For example, the area extends in the sense of circulation of the first mobile element 170 proportionately to the speed of the first mobile element 170, and decreases in the opposite sense of circulation of the first mobile element 170 proportionately to the speed of the first mobile element 170.

Furthermore, a mobile element positioned in the geographical area of the first mobile element 170 can be removed from the first list as a function of the speed of said element, of the distance between said element and the first mobile element 170, of the sense of circulation of said element and/or the position of said element.

In the same way, a mobile element positioned outside the geographical area around the first mobile element 170 can be added to the first list as a function of the speed of said element, of the distance between said element and the first mobile element 170, of the sense of circulation of said element and/or the position of said element.

For example, a mobile element can be removed from the first list if it is circulating at a high speed on another sub-route of the circulation route VC, behind the first mobile element 170 and in a sense of circulation opposite to the sense of circulation of the first mobile element 170.

In another example, a mobile element can be removed from the first list if it is circulating on another sub-route of the circulation route VC, in front of the first mobile element and in a sense of circulation opposite to the sense of circulation of the first mobile element 170, but at a low speed.

In another example, a mobile element can be added to the first list if it is circulating on another sub-route of the circulation route VC, in front of the first mobile element 170, in a sense of circulation opposite to the sense of circulation of the first mobile element 170, and at a high speed.

In another example, a mobile element can be removed from the first list if it is circulating on another sub-route of the circulation route VC, behind the first mobile element 170, in the same sense of circulation, but at a speed less than the speed of the first mobile element 170.

In another example, a mobile element can be added to the first list if it is circulating on the same circulation route VC, behind the first mobile element 170, in the same sense of circulation, and at a speed greater than the speed of the first mobile element 170.

In another example, a mobile element can be added to the first list if it is circulating on the same circulation route VC, behind the first mobile element 170, in the same sense of circulation, but at a speed less than the speed of the first mobile element 170.

In another example, a mobile element can be removed from the first list if it is circulating on the same circulation route VC, in front of the first mobile element 170, in the same sense of circulation, and at a speed greater than the speed of the first mobile element 170.

In another example, a mobile element can be removed from the first list if it is circulating on a different circulation route from the circulation route VC of the first mobile element 170, and which does not open onto an intersection with the circulation route VC of the first mobile element 170 or which opens onto an intersection positioned behind the first mobile element 170.

In another example, a mobile element can be added to the first list if it is circulating at a high speed on a different circulation route from the circulation route VC of the first mobile element 170, and which opens onto an intersection positioned in front of the first mobile element 170.

At least one other element can be added to the first list as a function of provisional items of context-related data DCO of the first mobile element 170 and/or of said element, at at least a second instant corresponding to the first instant to which is added a provisional time period taken to perform one or more actions of a series of actions determined in step E430. The provisional items of context-related data can be:

a provisional geolocation position, and/or
a provisional speed, and/or
a direction of traveling, and/or
a provisional sense of traveling.

In a variant, said at least one other element is added to a second list corresponding to said second instant (or to a time period between the second instant and a third instant, said time period corresponding to a provisional time period taken to perform one or more actions of a series of actions determined in step E430). Several other lists corresponding to other instants can thus be created.

The items of context-related data DCO and the provisional items of context-related data DCO can be obtained by the first terminal 110 by consulting the main remote server 120 or the secondary server 140 concerned.

The provisional geolocation position of the first mobile element 170 can be determined as a function of the speed of the first mobile element 170 at the moment of the implementation of the sub-step E424, of the provisional speed and/or the provisional trajectory of the first mobile element 170, and/or of one or more actions of the series of actions determined in step E430.

The provisional geolocation position of a neighboring element of the list can be determined as a function of items of context-related data DCO obtained by the terminal associated with said neighboring element in step E408 then sent to step E410, such as the provisional trajectory, the provisional journey, the most recent speed or speeds, and/or the change in speed.

The provisional geolocation position of a neighboring element of the list can be determined as a function of a potential impact of the performing of one or more actions of the series of actions by the first mobile element 170 on the items of context-related data DCO of the neighboring element.

In the event of the element of the list not being associated with a terminal able to implement steps E408 and E410, the items of context-related data DCO of said terminal can be obtained and sent by another terminal associated with another element positioned near said element of the list.

Step E420 can then comprise a sub-step E426 of confirming the geolocation position PG of at least one neighboring element of the list determined in sub-step E424, by means of a measurement made by the first terminal 110.

This sub-step E426 is implemented by the first terminal 110 and can be repeated for several neighboring elements.

In addition, the sub-step E426 can make it possible to update the geolocation position, particularly in the event of the period of repetition of steps E408 and E410 being long, or in the event of the neighboring element not being associated with a terminal able to implement steps E408 and E410. The sub-step E432 can also make it possible to position an element with respect to another.

During the implementation of this sub-step E426, the neighboring element is detected by the first terminal 110. A geolocation position of the neighboring element and where applicable an item of identification data DID of the neighboring element (typically registration plate number) can then be obtained.

Furthermore, one or more items of characterization data DC (typically the general category, and a sub-category of the general category) and/or one or more items of context-related data DCO (typically the direction of circulation, the sense of circulation, the speed, the change in speed, the number of users etc.) of the neighboring element can be obtained during the implementation of sub-step E426.

In an example, the first terminal 110 analyzes one or more images obtained by the onboard camera of the first terminal 110 or of the first mobile element 170 in order to identify the neighboring element and determine the distance between the first mobile element 170 and the neighboring element. Thus, an item of identification data and/or a geolocation position of the neighboring element can be obtained.

More precisely, the neighboring element can be identified by comparing the image of the neighboring element transmitted by the camera with image templates of predetermined elements in order to determine the type of element (brand, color, model, size etc.), then by comparing the determined type with the items of characterization data of the neighboring element.

The neighboring element can furthermore be identified by extracting its registration number from the obtained image and by comparing it with the item of identification data of the neighboring element.

Furthermore, the distance between the first mobile element 170 and the neighboring element can be determined by comparing the image of the neighboring element with a reference image representing an element of the same type as the neighboring element.

The proportions of the neighboring element on the obtained image can in particular be compared with the proportions of the element of the reference image, while taking into account the conditions of capture of the transmitted image and the reference image, in order to determine the distance.

The distance between the first mobile element 170 and the neighboring element can furthermore be determined as a function of a geolocated external element, such as a mile marker.

In another example that can be combined with the preceding examples, in order to identify the neighboring element and determine the distance between the first mobile element 170 and the neighboring element, the first terminal 110 analyzes an electromagnetic signal sent by means of the radar of the first terminal 110 or of the first mobile element 170, reflected by the neighboring element, then received by the radar.

More precisely, the neighboring element can be identified by determining the signature echo of said element in the received signal. The distance between the first mobile element 170 and the neighboring element can also be obtained, typically on the basis of the time elapsed between the sending of the signal and the reception of the reflected signal.

In another example that can be combined with the preceding examples, in order to identify the neighboring element and determine the distance between the first mobile element 170 and the neighboring element, the first terminal 110 analyzes a laser signal sent by means of the laser scanner of the first terminal 110 or of the first mobile element 170, reflected by the neighboring element, then received by the scanner.

One or more items of characterization data of the second element 130 (for example the vehicle type) can be obtained by analyzing the received signal, typically using charts. The distance between the first mobile element 170 and the neighboring element can also be obtained, typically on the basis of the time elapsed between the sending of the signal and the reception of the reflected signal.

The detected neighboring element can then be searched for in the list or lists obtained in sub-step E424, in order to confirm the geolocation position or update it.

More precisely, the geolocation position obtained in sub-step E426 can be compared with one or more geolocation positions of the list or lists obtained in sub-step E424.

Furthermore, the item of identification data obtained in sub-step E426 can be compared with one or more items of identification data of the list or lists obtained in sub-step E424.

If the item of data is updated, the first terminal 110 can send the updated item of data to the main remote server 120 or to the secondary remote server 140 corresponding to the geographical area 150 in which the first mobile element 170 is positioned.

Furthermore, if the item of data is confirmed, the first terminal 110 can send an acknowledgement of the item of data to the main remote server 120 or to the secondary remote server 140 corresponding to the geographical area 150 in which the first mobile element 170 is positioned.

During the implementation of sub-step E426, a new neighboring element, i.e. a neighboring element which is not included in the list or lists, can be detected. This new neighboring element is typically an obstacle on the circulation route VC, or an animal or a human being, for example positioned on the side of the route VC on which the first mobile element 170 is circulating.

The new neighboring element is then added to the list or lists, and the geolocation position of this new element is obtained. One or more other items of identification data DID, characterization data DC or context-related data DCO can also be obtained.

The first terminal 110 can send the item or items of data concerning the new neighboring element to the main remote server 120 or to the secondary remote server 140 corresponding to the geographical area 150 in which the first mobile element 170 is positioned.

The step E420 can then further comprise a sub-step of confirming the speed and/or the trajectory of at least one neighboring element of the list or lists determined in sub-step E424 (for example several neighboring elements), by means of a measurement made by the first terminal 110.

More precisely, sub-step E426 can be repeated in order to obtain several successive geolocation positions of the neighboring element, in order to deduce therefrom the speed of the neighboring element (or the speed difference between the neighboring element and the first mobile element 170) and/or the trajectory of the neighboring element.

Other items of identification data DID, characterization data DC or context-related data DCO can also be confirmed or updated by the first terminal 110. Furthermore, the first terminal 110 can send acknowledgements or updated items of data to the main remote server 120 or to the secondary remote server 140 corresponding to the geographical area 150 in which the first mobile element 170 is positioned.

The step E420 can also comprise a sub-step E428 of detecting an action AC performed by the user of the first mobile element 170 when the first mobile element 170 is a living being. This sub-step E428 is implemented by the first terminal 110.

The action performed can be the triggering of a flashing light of the first mobile element 170 and/or the depression of a brake pedal or accelerator pedal.

The first terminal 110 can determine the event EV using a first table of correspondence taking as input a set of items of data comprising:

- one or more items of data of the first mobile element 170 of the series of items of data determined in sub-step E422, and/or
- one or more neighboring elements of the list or lists determined in sub-step E424, i.e. one or more items of data obtained in sub-step E464,
- one or more actions performed by the user or the first mobile element 170, detected in sub-step E428, and/or
- one or more received messages, sent (typically during the implementation of step E550 described below) by one or more neighboring elements of the list or lists determined in sub-step E424, each message being able to indicate an action performed by the neighboring element sending the message.

The first table of correspondence typically comprises several events, each event corresponding to a different set of items of data.

The detected event thus corresponds to a situation observed in a neighborhood of the first mobile element 170, which can involve one or more other elements, and/or an action performed by the user of the first mobile element 170 (or the first mobile element 170).

In an example, the determined event EV is the presence, on the circulation route VC of the first mobile element 170, of an obstacle, or of a mobile element (typically the second mobile element 180) circulating:

- on the same circulation sub-route as the first mobile element 170,
- in the same sense of circulation as the first mobile element 170,
- in front of the first mobile element 170, and
- at a speed less than the speed of the first mobile element 170, and also where applicable the presence of another mobile element circulating:

- on the same circulation sub-route,
- in the same sense of circulation as the first mobile element 170, and
- behind the first mobile element 170, and also where applicable the presence of another mobile element circulating:

- on another circulation route,
- in the same sense of circulation as the first mobile element 170, and
- behind the first mobile element 170,
- or the presence of another mobile element circulating:
- on another circulation sub-route,
- in the opposite sense of circulation to the first mobile element 170, and
- in front of the first mobile element 170.

The determined event EV can also be the arrival of the first mobile element 170 at an intersection between its circulation route VC and another circulation route, as well as, where applicable:

- an obligation to give right of way to the mobile elements circulating on the other circulation route, and/or
- the presence of another mobile element on the other circulation route, which can arrive at the intersection at the same time as the first mobile element 170.

The first table of correspondence is a data structure that can take the form of one or more trees, each tree comprising a main branch, each main branch being able to divide into at least two sub-branches and so on. The main branch of each tree can then correspond to a global event corresponding to a first set of items of data (for example an arrival of the first mobile element 170 at an intersection) and each sub-branch corresponding to a more precise event corresponding to a second set of items of data (for example an arrival of the first mobile element 170 at an intersection, a neighboring element also arriving at the intersection). If the first set of items of data is verified, each second set of items of data of the sub-branch is then looked at, and so on.

In a variant, the step E420 is implemented by the main remote server 120 or the secondary remote server 140 associated with the geographical area 150 in which the first mobile element 170 is positioned. The items of data obtained by the first terminal 110 in sub-step E426 and/or sub-step E428 are then sent by the first terminal 110 to the server 120 or 140.

Next, in a step E430, a series of actions SAC that can be performed in response to the event determined in step E420 is determined, by consulting a second table of correspondence between at least one event and at least one series of actions.

The step E430 can be implemented by the first terminal 110 and/or the main remote server 120 or the secondary remote server 140 associated with the geographical area 150 in which the first mobile element 170 is positioned.

The series of actions SAC that can be performed comprises at least one action, typically several actions. Furthermore, the second table of correspondence typically comprises several events, each event being associated with a series of actions that can be performed.

The second table of correspondence is developed beforehand by associating with a predefined event the most suitable action or actions in response to the event. This association is thus determined as a function of the potential outcome of the performing of each action in response to the event.

It is thus possible to retrieve, on the basis of the event determined in step E420, the series of actions that can be performed in response to this event.

Each action can be a modification of a driving parameter, such as a change of trajectory or a modification of speed (acceleration or slowing down) or, in a variant, the display of a message.

In an example, a first predefined event is the presence, on the circulation route VC of the first mobile element 170, of an obstacle, or a mobile element (typically the second mobile element 180) circulating:

- on the same circulation sub-route as the first mobile element 170,
- in the same sense of circulation as the first mobile element 170,
- in front of the first mobile element 170, and
- at a speed less than the speed of the first mobile element 170, and also where applicable the presence of another mobile element circulating:

- on the same circulation sub-route,
- in the same sense of circulation as the first mobile element 170, and
- behind the first mobile element 170, and also where applicable the presence of another mobile element circulating:

on another circulation route, in the same sense of circulation as the first mobile element 170, and behind the first mobile element 170, or the presence of another mobile element circulating:

on another circulation sub-route, in the opposite sense of circulation to the first mobile element 170, and in front of the first mobile element 170.

The series of actions SAC that can be performed, associated with this first predefined event, can comprise an acceleration of the first mobile element 170 and a change of trajectory of the first mobile element 170 in order to overtake the mobile element circulating on the same circulation sub-route as the first mobile element 170, in the same sense of circulation as the first mobile element 170, and in front of the first mobile element 170 (or in order to overtake the obstacle), where applicable preceded by a wait and where applicable a slowing-down of the first mobile element 170 in order to let the other mobile element circulating on the other circulation sub-route pass.

A second predefined event can be the arrival of the first mobile element 170 at an intersection between said circulation route VC and another circulation route, as well as, where applicable:

an obligation to give right of way to the mobile elements circulating on the other circulation route, and/or the presence of another mobile element on the other circulation route, which can arrive at the intersection at the same time as the first mobile element 170.

The series of actions SAC that can be performed, associated with this second predefined event, can comprise an deceleration of the first mobile element 170 or a stopping of the first mobile element 170 in order to let the other mobile element pass, then an acceleration in order to move past the intersection.

The series of actions can be initiated or modified, for example following a step F550 of receiving a message, described in more detail below with reference to FIG. 6.

Each action can be associated with an instant at which the performing of the action starts and/or a provisional time period of the action.

The instant at which the performing of the action starts and/or the provisional time period for one or more actions can be obtained in this step E430.

The instant at which the performing of the action starts and/or the provisional time period are obtained as a function of items of context-related data DCO of the first mobile element 170 and where applicable as a function of items of context-related data DCO of one or more neighboring elements of the list or lists determined in sub-step E424. The speed, the trajectory and the sense of traveling can for example be considered.

The instant at which the performing of the action starts is typically in the form of GMT, or in the form of a remaining time period. The instant at which the performing of the action starts is thus not necessarily immediate.

In a step E440, for at least one action of the series of actions SAC determined in step E430, a communications scenario SC associated with said action is determined.

Step E440 can be implemented by the first terminal 110 and/or the main remote server 120 or the secondary remote server 140 associated with the geographical area 150 in which the first mobile element 170 is positioned.

The communications scenario SC comprises at least one message, typically a series of several messages. Each message of the scenario is intended to be sent or received by the first terminal 110, before the potential performing of the action corresponding to the communications scenario.

As described in more detail below, one and the same message of the series can have several recipients. Furthermore, several messages of the series can be sent to one and the same recipient, typically in succession.

The sending and receiving of the messages of the scenario allow the first terminal 110 to warn neighboring elements that the action should be performed and can allow it to make sure that the action can be performed.

The scenario SC is for example determined by consulting a third table of correspondence between at least one action and at least one communications scenario SC.

The third table of correspondence typically comprises several actions, each action being associated with a scenario SC. It is thus possible to retrieve the communications scenario corresponding to the action.

The third table of correspondence is developed beforehand by associating with a predefined action the most suitable scenario for implementing the action.

Step E440 can be implemented for several actions of the series of actions SAC determined in step E430, for example all the actions of this series.

Step E440 comprises a sub-step E442 of selecting, in the first list of neighboring elements determined in sub-step E424, for at least one message of the communications scenario SC, one or more recipient neighboring elements ED of said message.

In a variant, the element or elements are selected from a second list determined in sub-step E424, corresponding to the instant at which the performing of the action under consideration starts. The element or elements are then selected as a function of the instant at which the action under consideration starts and/or the time period for the action under consideration.

This selection of recipient neighboring elements ED makes it possible to send a message only to the neighboring elements concerned, i.e. to the neighboring elements on which the action corresponding to the message can have an impact, and thus makes it possible to reduce the number of messages sent and therefore not to congest the network. The selection therefore depends on the action under consideration.

The impact of the action on the neighboring element can be a collision between the first mobile element 170 and the neighboring element, or the modification of a driving parameter of the element (such as the trajectory or the speed).

When this action is a braking of the first mobile element 170, a neighboring element that can be impacted is a mobile neighboring element positioned on the same circulation route VC as the first mobile element 170, in the same sense of circulation as the first mobile element 170, and behind the first mobile element 170.

When the action is an acceleration of the first mobile element 170, a neighboring element that can be impacted is a mobile neighboring element positioned on the same circulation route VC as the first mobile element 170, in the same sense of circulation as the first mobile element 170, and in front of the first mobile element 170.

When the action is a change of trajectory of the first mobile element 170, a neighboring element that can be impacted is a neighboring element that can cross the first mobile element 170, typically a neighboring element circulating in a different direction and/or sense from the direction and/or sense of the first mobile element 170, such that the trajectory of the neighboring element can cut off or meet the trajectory of the first mobile element 170.

In an example, a risk of impact of the action on each neighboring element of the list is calculated in this sub-step E422.

The risk of impact is calculated as a function of items of context-related data of the first mobile element 170 and of the neighboring element.

The risk of impact is typically calculated as a function of:

- the geolocation position of the first mobile element 170,
- the geolocation position of the neighboring element,
- the provisional trajectory of the first mobile element 170,
- the provisional trajectory of the neighboring element,
- the speed of the first mobile element 170,
- the speed of the neighboring element and its predicted changes,
- an item of information (communication, flashing light, flash of headlights from another vehicle etc.) issued by a neighboring element and concerning an item of context-related data DCO of this neighboring element or another neighboring element.

If the risk is greater than a threshold, the neighboring element is selected and then becomes a recipient neighboring element of the message.

An item of identification data of each recipient neighboring element of the message, typically the MSISDN number of the terminal associated with the recipient neighboring element of the message, is then obtained, for example by consulting the main remote server 120.

In the event of the neighboring element not being able to receive and/or interpret the message, the neighboring element is not selected. Another visible element of the element and including a display module such as a screen (typically a display panel or a truck) can then be selected instead of the neighboring element, so that it can then display part of the message to warn the user of the neighboring element.

The sub-step E442 can be implemented for several messages of the communications scenario SC, for example all the messages of the scenario SC.

The element or elements receiving several messages can thus be searched for.

In a sub-step E444 of step E440, the item of content CM of at least one message of the communications scenario SC is determined.

The content CM can be normalized. In addition, the item of content can comprise at least one item of information from among the following list of items of information:

- the scenario determined in step E440,
- the action corresponding to said message,
- an item of context-related data of the first mobile element 170 depending on said action corresponding to said message,
- a number of the message in said scenario,
- an identifier of the issuer of said message,
- a time indicator concerning said action corresponding to said message,
- a time indicator concerning at least one or more other actions of said series of actions,
- an indicator concerning the follow-up to be given to said message,
- a list of possible responses comprising at least one response.

The item of context-related data of the first mobile element 170 depending on said action corresponding to said message is for example a provisional trajectory of the first mobile element 170 depending on said action (typically a direction of circulation and/or a sense of circulation), and/or a change in the speed of the first mobile element 170 depending on said action.

The identifier of the issuer of said message is typically the MSISDN number of the first terminal 110.

The time indicator concerning the action can comprise an instant at which the performing of the action starts, typically in the form of GMT (Greenwich Mean Time), in seconds starting from the 1 Jan. 1970, or in the form of a remaining time period, or comprise a remaining time period before the instant at which the performing of the action starts.

The time indicator concerning the action can further comprise a provisional time period taken to perform the action. The value of the time period is typically of a few seconds, for example 15 seconds for a braking action when the speed of the first mobile element 140 is 170 km/h, 40 seconds for overtaking a vehicle according to a given speed difference, etc. The items of context-related data of the first mobile element 170 are therefore used for determining said provisional time period.

The indicator concerning the follow-up to be given to the message can comprise an item of information indicating:

- that the message is for information purposes only, no message thus having to be sent following the receiving of this message, or
- that one or more messages must be sent, as well as the items of identification data and where applicable context-related data of the recipient elements of these messages.

The indicator concerning the follow-up to be given to the message can furthermore comprise an item of information indicating whether one or more actions should be performed following the receiving of the message (a suggestion of action).

The list of possible responses comprises at least one message that can be sent and/or at least one action that can be performed following the receiving of the message. Each message that can be sent is typically normalized and can be part of the communications scenario.

The list of possible responses can furthermore comprise the instants of sending of the message that can be sent and/or performing of the action that can be performed, as well as the provisional time period for this action.

The action that can be performed is typically the modification of a driving parameter. In a variant, the action that can be performed is a display of part of the message. The list can then comprise an item of identification data of the element that can be warned by the display (typically its registration plate), display instructions and the message to be displayed.

The list of items of information can also comprise the application used by the first terminal to implement the method.

In a variant, the message is a SIP-option message, intended to be sent according to an RCS protocol.

In an example, each item of information is preceded in the message by:

- a reference code indicating the type of item of information, and
- a first separating character.

In an example, the reference code of the item of information of "application" type is AP, the reference code of the item of information of "scenario" type is SC, the reference code of the item of information of "action" type is ST, and the reference code of the item of information of "identifier of the issuer" type is SE.

The first separating character is for example a punctuation sign, typically a colon.

In addition, each item of information can be separated from the following item of information by a second separating character, typically the symbol "$$".

Items of information of the same type are indexed. For example the message comprises three items of information of the same type, the reference code of this type of item of information being AN, the reference code of the first item of information is AN1, and the reference code of the second item of information is AN2, the two items of information being separated by the second separating character.

When the follow-up to be given to the message comprises several messages that must be sent, the item of identification data and the type of element of each recipient can be indicated, preceded by the same reference code, the item of identification data and the type of element being separated by the second separating character.

For example, if the reference code for the recipient elements is DE, this gives for two recipients the following follow-up:

DE1: 0645858596$$cc1$$DE2: 0658995566$$cc2, wherein DE1 and DE2 is the indexed reference code of each recipient element, each reference code being followed by the item of identification data ("0645858596" and "0658995566") then the type of element of each recipient ("cc1" and "cc2").

Figure 5:
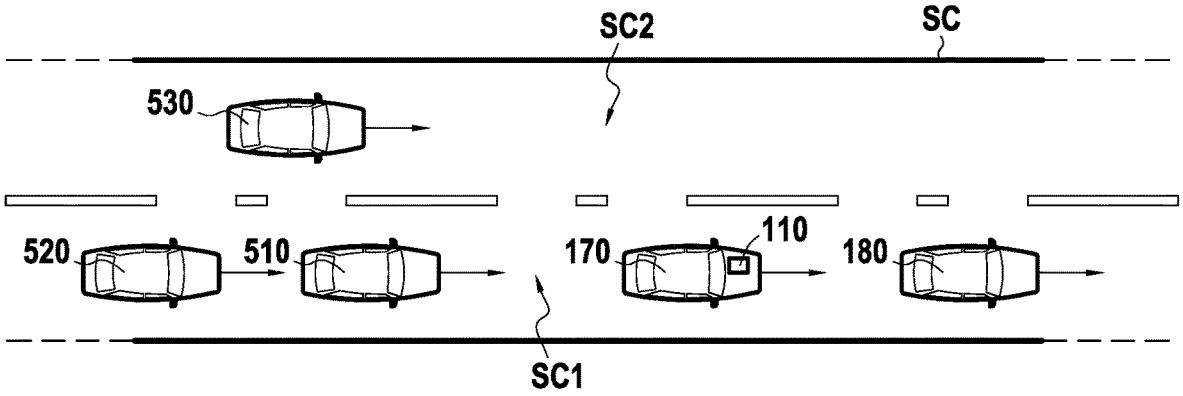
FIG. 5 shows a first mobile element associated with a first terminal of a system able to implement a method according to an exemplary embodiment of the invention.

In an example illustrated in FIG. 5, the first mobile element 170 and the second mobile element 180 are vehicles circulating on the right-hand sub-route SC1 of a circulation route SC. The second mobile element 180 is circulating in front of the first mobile element 170, the first mobile element 170 wishes to overtake the second mobile element 180, and the second mobile element 180 has given its consent to the first mobile element 170 in the course of a previous exchange forming part of the scenario SC.

In this example the first mobile element 170 must indicate its action (overtaking the second mobile element 180) to the two vehicles 510, 520 following it on the right-hand sub-route SC1, without waiting for a reply from these vehicles 510, 520.

Furthermore, in this example, the first mobile element 170 must indicate its action to the vehicle 530 which is arriving on a left-hand sub-route SC2 of the circulation route SC, and wait for its reply to embark on the action.

In addition, in this example:

- the item of identification data of the first mobile element 170 is 0600000000,
- the reference code of the communications scenario to be applied is DA (overtaking on a freeway),
- the reference code of the message number is 3 (since a first message has been sent by the first mobile element 170 to ask the second mobile element 180 for the authorization to overtake it and a second message has been sent by the second mobile element 180 to the first mobile element 170 to give it the authorization to overtake it),
- the items of identification data of the two vehicles 510, 520 following the first mobile element 170 on the right-hand sub-route SC1 are 0611111111 and 0611111112,
- the item of identification data of the vehicle circulating on the left-hand sub-route SC2 is 0622222222,
- the reference code of the type of vehicle for the two vehicles 510, 520 following the first mobile element 170 is VD, and
- the reference code of the type of vehicle for the vehicle 530 circulating on the left-hand sub-route SC2 is VG.

The first terminal 110 associated with the first mobile element 170 can then send a message to the vehicle 530 arriving on the left-hand sub-route SC2, and the item of content of the message can then be as follows:

AP:GE $$ SC:DA $$ ST:3 $$ SE:0600000000 $$ TM:RERA $$ AE:DO $$ AS:12 $$ AD: 75 $$ AN1:0K $$ AN2: KO $$ OD: 0611111111 $$VG $$ OD: 0611111112 $$VG,

In this message, the following reference codes are applied:

- "AP" for the application,
- "SC" for the scenario,
- "ST" for the number of the message in the scenario,
- "SE" for the identifier of the issuer,
- "TM" for the indicator concerning the follow-up to be given to the message,
- "AE" for the action,
- "AS" for the instant at which the performing of the action starts,
- "AD" for the provisional time period for the action,
- "AN" for the list of possible messages in response to the first mobile element,
- "OD" for the recipient elements of the messages that can be sent.

Furthermore, in this message, the RERA code means that a message should be sent to the first mobile element 170 and another message should be sent to the two vehicles 510, 520 following the first mobile element 170 on the right-hand sub-route SC1.

The sub-step E444 can be implemented by several messages of the communications scenario SC, for example all the messages of this scenario SC.

Figure 6:
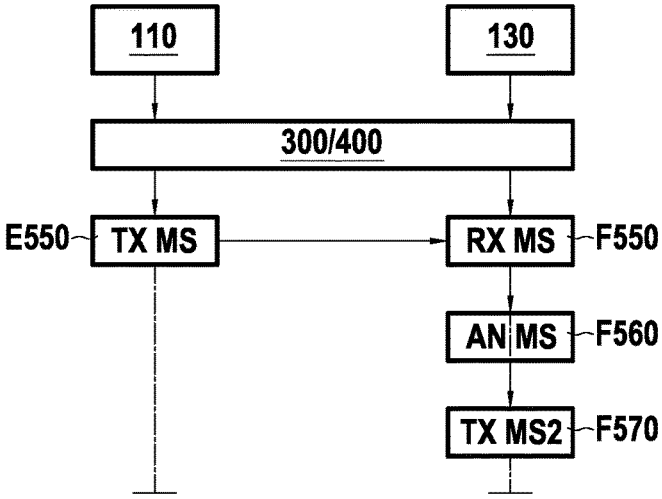
FIG. 6 shows, in the form of a flow chart, the main steps of a method for communicating according to an exemplary embodiment of the invention.

FIG. 6 shows a method for communicating according to an exemplary embodiment of the invention.

This method for communicating is implemented by a system such as the system 100 of FIG. 1.

The method for communicating comprises the method for determining 300 or 400 as described above with reference to FIG. 3 or to FIG. 4.

The method for communicating furthermore comprises a step E550, wherein at least one message MS of the communications scenario SC determined in step E440 is sent, via the telecommunications network 160, by the first terminal 110 to the terminal associated with the recipient neighboring element of said message, determined in sub-step E442, or to the terminals associated with the recipient neighboring elements.

In an example, the sending is carried out according to an RCS protocol, the message being a SIP-option message.

The message MS is typically sent before the instant at which the performing of the action associated with the scenario SC starts.

Step E550 can be repeated for each message MS of the scenario SC.

In the remainder of the description, it will be considered that the recipient element is the second mobile element 180. A message MS is thus sent to the second terminal 130.

The sent message or messages MS can also be transmitted to a remote server dedicated to the storage of a history of sent messages, in order to be kept.

In a step F550, the second terminal 130 receives the message MS.

Next, in a step F560, the second terminal 130 analyzes the message MS.

If the message MS comprises an item of information indicating that one or more messages MS2 must be sent in response to the message MS, the second terminal 130 extracts from the message the items of identification data and where applicable items of context-related data of the recipient elements of these messages MS2 that can be sent, then the list of possible responses.

The second terminal 130 then determines the item of content of the message or messages MS2 that can be sent using the abovementioned items of information, then sends (step F570) the message or messages MS2. The sub-step E444 can be implemented by the second terminal to determine the item of content.

Step F550 and where applicable steps F560 and F570 can be implemented by each terminal to which a message of the scenario is sent in step E550.

If a recipient element is the first terminal 110, the message MS2 sent to the first terminal 110 can be part of the communications scenario. The first terminal 110 can, following the receiving of this message MS2 sent by the second terminal 130, repeat step E550 to send yet another message of the communications scenario.

The message MS2 sent by the second terminal 130 can furthermore modify the event occurring on the circulation route SC and/or the communications scenario. The steps E420, E430, E440, E550, F550, F560 and/or F570 are then repeated taking into account this message.

Thus, one or more neighboring elements separate from the elements selected during the first iteration of the sub-step E424 can be selected during this repetition, then contacted.

In addition, the first terminal can determine a new event when the implementation of the method for the previously determined event is not yet finished. The implementation of the method for the previously determined event can then be interrupted and steps E420, E430, E440, E550, F550, F560 and/or F570 can then be repeated for this new event, where applicable taking into account the messages previously exchanged between the terminals.

The invention claimed is:

1. A method comprising:

determining a communications scenario corresponding to at least one action that can be performed by a first mobile element located on a circulation route, in response to at least one event, the determining step being implemented by a first terminal incorporated into the first mobile element, wherein the determining comprises the following steps:

obtaining a list of neighboring mobile elements comprising at least one neighboring element in the neighborhood of the first mobile element;

determining at least one event in a neighborhood of the first mobile element involving at least one neighboring element of the obtained list obtaining a table of correspondence relating events and series of actions, each of the series of actions comprising at least one action;

determining a series of actions that can be performed in response to the step of determining at least one event by accessing the obtained table of correspondence, the determined series of actions comprising a modification of a driving parameter of the first mobile element;

obtaining a table of correspondence relating actions and communications scenarios, each of the communications scenarios comprising a transmission of at least one message; and for at least one action of said series of actions, determining a communications scenario associated with said at least one action by accessing the table of correspondence relating actions and communications scenarios, wherein the step of determining a communications scenario comprises a sub-step of selecting, from said list, for at least one message of the communications scenario, at least one recipient neighboring element of said message that has a risk of being impacted by the performing of the determined series of actions greater than a predetermined threshold;

transmitting, by the first mobile element, an item of context-related data to a first remote server handling a first area in which the first mobile element is located;

determining, by the first remote server, a second remoter server handling a provisional area in which the first mobile element could be located in the future; and transmitting, by the first remote server, the item of context-related data to the second remote server.

2. The method according to claim 1, wherein said determining at least one event comprises, for said at least one action of said at least one series of actions, determining an instant at which the performing of the action starts and a time period taken to perform the action, such that said at least one recipient neighboring element of said message is selected as a function of said instant at which the performing of the action starts and of said time period taken to perform the action.

3. The method according to claim 1, wherein the step of determining a communications scenario comprises obtaining an MSISDN number of a terminal associated with said at least one recipient neighboring element of said message.

4. The method according to claim 1, wherein at least one neighboring element of said list of neighboring elements is determined as a function of:

a geolocation position, and/or a speed, and/or a direction of traveling, and/or a sense of traveling, of said first mobile element and said neighboring element, at a first instant corresponding to the implementation of the determination of the list of neighboring elements, and to at least a second instant corresponding to the first instant to which is added a provisional time period taken to perform one or more actions of the series of actions.

5. The method according to claim 4, wherein the step of determining said at least one event further comprises a sub-step of confirming the geolocation position of said at least one neighboring element of the list of neighboring elements, by using a measurement made by the first terminal.

6. The method for according to claim 1, further comprising:

sending, by the first terminal and via a telecommunications network, said at least one message of the scenario to said recipient neighboring element.

7. The method according to claim 6, wherein the sending is carried out according to a Rich Communication Service (RCS) protocol, and said at least one message is a Session Initiation Protocol (SIP)-option message.

8. A terminal comprising:

a processor; and a non-transitory computer-readable medium comprising instructions stored thereon which when executed by the processor configure the terminal to perform acts comprising:

determining a communications scenario corresponding to at least one action that can be performed by a first mobile element located on a circulation route, in response to at least one event, wherein the act of determining comprises:

obtaining a list of neighboring mobile elements comprising at least one neighboring element in the neighborhood of the first mobile element;

determining at least one event in a neighborhood of the first mobile element involving at least one neighboring element of the obtained list;

obtaining a table of correspondence relating events and series of actions, each of the series of actions comprising at least one action;

determining a series of actions that can be performed in response to the act of determining at least one event by accessing the obtained table of correspondence, the determined series of actions comprising a modification of a driving parameter of the first mobile element; and obtaining a table of correspondence relating actions and communications scenarios, each of the communications scenarios comprising a transmission of at least one message;

for at least one action of said series of actions, determining a communications scenario associated with said at least one action by accessing the table of correspondence relating actions and communications scenarios, wherein the act of determining a communications scenario comprises a sub-step of selecting, from said list, for at least one message of the communications scenario, at least one recipient neighboring element of said message that has a risk of being impacted by the performing of the determined series of actions greater than a predetermined threshold;

transmitting, by the first mobile element, an item of context-related data to a first remote server handling a first area in which the first mobile element is located;

determining, by the first remote server, a second remoter server handling a provisional area in which the first mobile element could be located in the future; and transmitting, by the first remote server, the item of context-related data to the second remote server.

9. A non-transitory recording medium readable by a computer on which is recorded a computer program comprising instructions for executing a method, when the instructions are executed by a processor of the first terminal the first terminal is configured to perform acts of the method comprising:

determining a communications scenario corresponding to at least one action that can be performed by a first mobile element located on a circulation route, in response to at least one event, wherein the act of determining comprises:

obtaining a list of neighboring mobile elements comprising at least one neighboring element in the neighborhood of the first mobile element;

determining at least one event in a neighborhood of the first mobile element involving at least one neighboring element of the obtained list;

obtaining a table of correspondence relating events and series of actions, each of the series of actions comprising at least one action;

determining a series of actions that can be performed in response to the act of determining at least one event by accessing the obtained table of correspondence, the determined series of actions comprising a modification of a driving parameter of the first mobile element;

obtaining a table of correspondence relating actions and communications scenarios, each of the communications scenarios comprising a transmission of at least one message; and for at least one action of said series of actions, determining a communications scenario associated with said at least one action by accessing the table of correspondence relating actions and communications scenarios, wherein the act of determining a communications scenario comprises a sub-step of selecting, from said list, for at least one message of the communications scenario, at least one recipient neighboring element of said message that has a risk of being impacted by the performing of the determined series of actions greater than a predetermined threshold;

transmitting, by the first mobile element, an item of context-related data to a first remote server handling a first area in which the first mobile element is located;

determining, by the first remote server, a second remoter server handling a provisional area in which the first mobile element could be located in the future; and transmitting, by the first remote server, the item of context-related data to the second remote server.

10. The terminal according to claim 8, wherein the acts comprise sending via a telecommunications network said at least one message of the scenario to said recipient neighboring element.

11. The method according to claim 1, wherein determining at least one event comprises:

determining a sense of circulation, speed, and position of the involved neighboring element, and/or detecting an action performed by a user of the first mobile element.

12. The method according to claim 1, further comprising calculating a risk of being impacted by the performing of the determined series of actions as a function of items of context-related data of the first mobile element and of the at least one neighboring element.

13. The method according to claim 1, wherein each neighboring mobile element of the list is determined as a function of items of context-related data of the first mobile element and/or of the at least one neighboring element.

* * * * *